US007543465B2

(12) United States Patent
Kwon et al.

(10) Patent No.: US 7,543,465 B2
(45) Date of Patent: Jun. 9, 2009

(54) DETERGENT BOX, DETERGENT BOX ASSEMBLY, AND WASHING MACHINE WITH THE SAME

(75) Inventors: Ho Cheol Kwon, Changwon-si (KR); Beom Jun Kim, Gimhae-si (KR); Il Hyeok Yim, Goyang-si (KR); Kang Mo Choi, Masan-si (KR); Hack Chai Song, Changwon-si (KR)

(73) Assignee: LG Electronics Inc., Seoul (KR)

( * ) Notice: Subject to any disclaimer, the term of this patent is extended or adjusted under 35 U.S.C. 154(b) by 549 days.

(21) Appl. No.: 11/337,793

(22) Filed: Jan. 24, 2006

(65) Prior Publication Data

US 2006/0162392 A1 Jul. 27, 2006

(30) Foreign Application Priority Data

Jan. 25, 2005 (KR) ..... 10-2005-0006622

(51) Int. Cl.
*D06F 39/02* (2006.01)

(52) U.S. Cl. ..... 68/17 R; 68/207

(58) Field of Classification Search ..... 68/17 R, 68/3 R, 207

See application file for complete search history.

(56) References Cited

U.S. PATENT DOCUMENTS

| | | | | |
|---|---|---|---|---|
| 4,917,272 | A * | 4/1990 | Ikeda | 222/231 |
| 5,399,006 | A * | 3/1995 | Murazumi | 312/109 |
| 2003/0172690 | A1 * | 9/2003 | Kim et al. | 68/17 R |

FOREIGN PATENT DOCUMENTS

| | | | |
|---|---|---|---|
| EP | 1449951 | A1 * | 8/2004 |

* cited by examiner

*Primary Examiner*—Joseph L Perrin
(74) *Attorney, Agent, or Firm*—KED & Associates, LLP

(57) ABSTRACT

A detergent box for a washing machine is provided. The detergent box is slidably coupled to a front portion of the washing machine, and has a structure that prevents release of the detergent box from the washing machine even if the washing machine is tilted or shaken, and that facilitates proper placement of the detergent box. The detergent box may include a stopper, and a rib having an elastic slot formed therein. The detergent box holds washing agents, and the dispenser is mounted in the washing machine so as to receive the detergent box therein. The dispenser has a recess for seating the stopper therein as the detergent box is placed in the dispenser. The rib may include an elastic slot to provide an elastic force to the stopper.

5 Claims, 4 Drawing Sheets

DETERGENT BOX, DETERGENT BOX ASSEMBLY, AND WASHING MACHINE WITH THE SAME

CROSS-REFERENCE TO RELATED APPLICATION

This application claims the benefit of Korean Application No. 10-2005-0006622, filed on Jan. 25, 2005, which is hereby incorporated by reference as if fully set forth herein.

BACKGROUND OF THE INVENTION

1. Field of the Invention

The present invention relates to a detergent box in a washing machine, and more particularly, to a detergent box in which a structure of the detergent box to be placed in a front of the washing machine is modified for preventing the detergent box from falling off even if the washing machine is tilted or shaken, and enabling a user to make an easy notice of proper placement of the detergent box.

2. Discussion of the Related Art

In general, the washing machine removes dirt from clothes or beddings (hereafter called as laundry) by using action of detergent and water (hereafter called as 'washing water'). In the washing machines, there are agitator type, pulsator type, and drum type washing machines.

The agitator type washing machine washes by rotating an upstanding washing pole at a center of an inner tub in both directions. The pulsator type washing machine washes by using friction between a water circulation and laundry taken place as a pulsator of a disk shape on a bottom of an inside of an inner tub is rotated in both directions. The drum type washing machine washes by putting washing water, detergent and laundry in a drum having a plurality of lifts projected from an inside surface and rotating the drum.

A related art drum type washing machine is provided with a body, a drum in the body for rotating laundry held therein, a detergent box over the drum for holding detergent, and a motor for rotating the drum. The detergent box is connected to the drum with a bellows for supplying the detergent from the detergent box to the drum.

In the meantime, the detergent box is placed in a dispenser in the cabinet of the drum type washing machine. A related art detergent box has a projection at one side, and the dispenser has a recess in one side opposite to the projection, for preventing the detergent box from being moved backward once the detergent box is placed in the dispenser, even if the washing machine is tilted, or vibrates due to rotation of the drum.

However, the falling off preventive structure formed at the related art detergent box and the dispenser has a problem in that the projection on the detergent box is worn down as a process is repeated, in which the detergent is put in after pulling and opening the detergent box, and closed again. Moreover, as the projection is worn down, there has been no way for determining whether the detergent box is placed in completely, or not.

SUMMARY OF THE INVENTION

The present invention is directed to a detergent box that substantially obviates one or more problems due to limitations and disadvantages of the related art.

An object of the present invention is to provide a detergent box in a washing machine having a falling off preventive structure which is not liable to be worn down even if the detergent box repeats an opening/closing operation.

Another object of the present invention is to provide a detergent box in a washing machine which enables to determine whether the detergent box is placed in fully or not by means of sound or feeling.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The detergent box of the present invention includes a stopper to be seated in the recess, and an rib for providing an elastic force to the stopper.

The detergent box holds the detergent, and the dispenser is mounted in the washing machine for placing the detergent box therein. The dispenser has a recess for seating the stopper therein as the detergent box is placed in the dispenser.

The rib provides an elastic force to the stopper. For providing a comparatively soft elastic force, the rib has an elastic slot near the stopper.

It is preferable that the rib is formed at a top of each side of the detergent box, to provide an appropriate elastic force by being bended. It is preferable that the stopper is projected downward from the rib.

The rib provides an elastic force to the stopper in up/down directions by being bended. If the rib can not be extended adequately in a lateral direction of the detergent box due to spatial restriction, to shorten a moment arm of the bending, the rib fails to secure an appropriate flexibility. By forming the elastic slot in the rib, a required appropriate flexibility can be secured.

The elastic slot may have any shape as far as it is to the purpose. The elastic slot may not pass through the rib in a vertical direction. However, it is preferable because fabrication of the slot is easy.

When the detergent box is being inserted into the dispenser, the stopper is compressed and slides along a surface of the dispenser having the recess formed therein, and when the stopper arrives to the recess, the stopper is seated in the recess as the compression of the stopper is released.

At the time the stopper is seated in the recess, a sound may be generated because the stopper may hit an inside of the recess as the compression of the stopper is released suddenly. Moreover, the vibration from sudden movement of the stopper can be transmitted to a hand of the user which is holding the detergent box handle. Such as sound or feeling from the vibration enables the user to notice that the detergent box has been placed, properly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
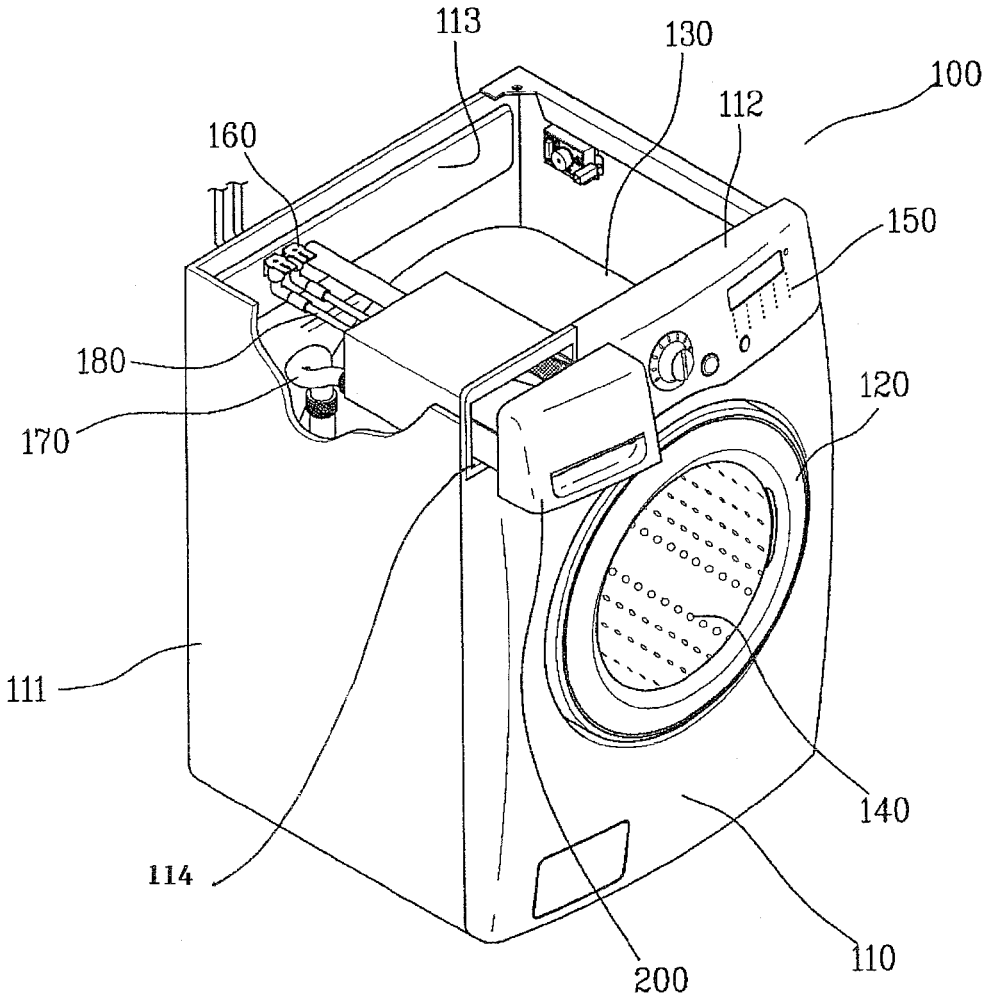
FIG. 1 illustrates a perspective view of a drum type washing machine having a detergent box mounting structure in accordance with a preferred embodiment of the present invention provided thereto.

FIG. 1 illustrates a perspective view of a drum type washing machine having a detergent box mounting structure in accordance with a preferred embodiment of the present invention provided thereto.

Referring to FIG. 1, the drum type washing machine 100 having a detergent box mounting structure in accordance with a preferred embodiment of the present invention provided thereto includes a cabinet 110 having side covers 111, a back cover 113, and a front cover 112 for protecting an inside thereof, a tub 130 in the cabinet 110, a drum 140 in the tub 130 for holding laundry, a door 120 at a center of the front cover 112 for opening/closing a front of the drum 140, a control panel 150 on one side of an upper side of the front cover 112 for controlling operation of the washing machine, a detergent holding unit 200 to be placed in one side of the control panel 150, water supply valves 160 at one side of the back cover 113 for supplying the washing water to the detergent holding unit 200, water supply pipe 180 connected between the water supply valves and the detergent holding unit 200, and a bellows 170 connected between the detergent holding unit 200 and the tub 130.

According to above configuration, after opening the door 120 and introducing the laundry into the drum 140, the user applies washing conditions to operation devices on the control panel 150. Then, upon pressing a start button, the washing water is supplied through the water supply valve 160, and introduced to the detergent holding unit 200 through the water supply pipe 180. The washing water is mixed with the detergent at the detergent holding unit 200, and the washing water mixed with the detergent is introduced to the tub 130 and the drum 140 through the bellows 170. When a water level of the washing water reaches to a preset level, the supply of washing water is stopped, and the drum 140 is rotated to start washing.

Figure 2:
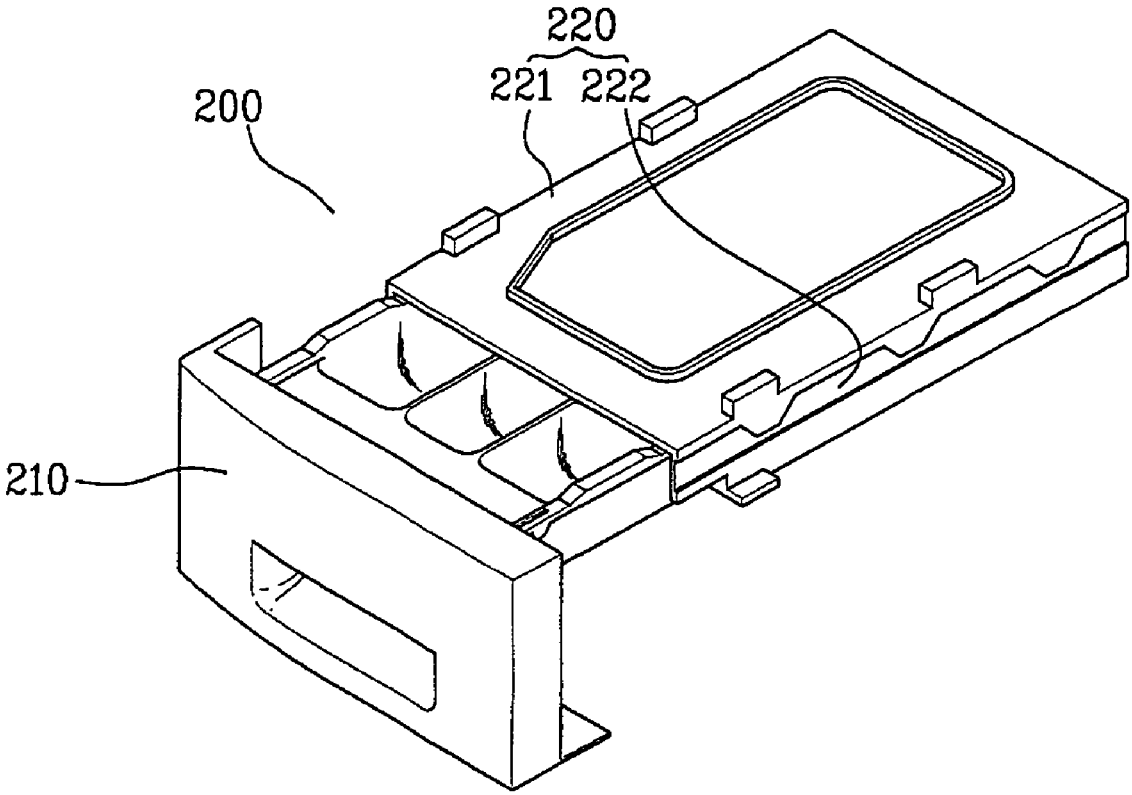
FIG. 2 illustrates a perspective view of a detergent holding unit having a detergent box mounting structure in accordance with a preferred embodiment of the present invention provided thereto.

FIG. 2 illustrates a perspective view of a detergent holding unit having a detergent box mounting structure in accordance with a preferred embodiment of the present invention provided thereto.

Referring to FIG. 2, the detergent holding unit 200 includes a detergent box 210 for putting detergent therein, and a dispenser 220 for placing the detergent box 210 therein for preventing the detergent from flying to an outside of the detergent holding unit 200 from the detergent box 210. In detail, the dispenser 220 includes a dispenser cover 221 for covering a top of the detergent box 210, and a dispenser body 222 on the dispenser cover 221 to surround an outside circumference of the detergent box 210.

The dispenser 220 can be securely mounted in the cabinet 110, and the detergent box 210 can be placed in the dispenser 220 or drawn a predetermined distance out of the dispenser 220. The detergent box 210 has a falling off preventive portion 214 (see FIG. 3) for preventing the detergent box 210 from falling off the dispenser 220 completely.

According to above configuration, after the user pulls out the detergent box 210 for a predetermined distance before starting the washing, fills the detergent in the detergent box 210. Then, the user pushes the detergent box 210 into the dispenser 220 again.

Figure 3:
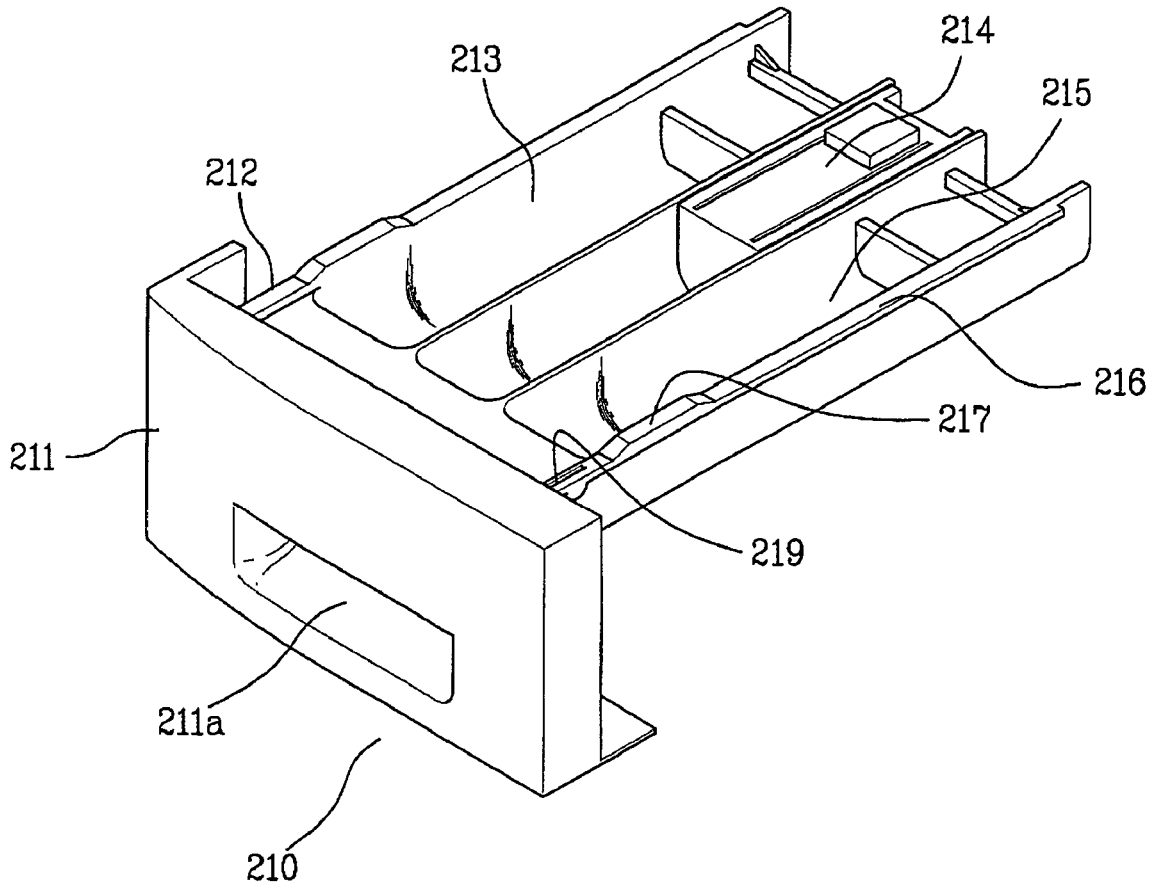
FIG. 3 illustrates a perspective view of a detergent box in accordance with a preferred embodiment of the present invention.
Figure 4:
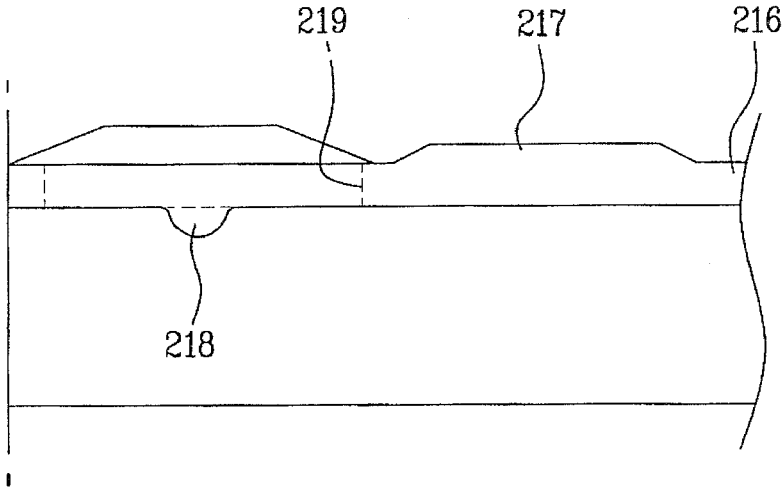
FIG. 4 illustrates a side view of a falling off preventive structure at one side of a detergent box.

FIG. 3 illustrates a perspective view of a detergent box in accordance with a preferred embodiment of the present invention, and FIG. 4 illustrates a side view of a falling off preventive structure at one side of a detergent box.

Referring to FIGS. 3 and 4, the detergent box 210 includes a box body 212, and a cover front 211 fixedly secured to a front of the box body 212.

In detail, in the cover front 211, there is a handle 211*a* for the user to put fingers therein and pull the detergent box 210 forward. Moreover, the box body 212 includes a bleaching agent holding portion 213, and a detergent holding portion 215 each recessed to a predetermined depth, and partitioned at a predetermined distance, and a falling off preventive portion 214 mounted between the bleaching agent holding portion 213 and the detergent holding portion 215, for preventing the detergent box 210 from falling off the dispenser 200, completely.

Moreover, the box body 212 includes ribs 216 each extended along a side edge for smooth sliding of the detergent box 210 into the dispenser 220, and push down projections 217 projected upward from the ribs 216 by predetermined heights, respectively. In detail, for preventing a top surface of the cover front 211 and a top cover (not shown) of the washing machine 100 from interfering with each other in a process the detergent box 210 is placed into the washing machine, the push down projections 217 press the detergent box 210 downward, slightly.

Moreover, there are stoppers 218 projected down from front and/or rear of the push down projections 217, respectively. At one side of the rib 216, there is an elastic slot 219 cut away at predetermined width and length.

In detail, the stopper 218 is placed in a recess 223 (see FIG. 5) in a top of the side of the dispenser body 222. If the detergent box 210 is placed in the dispenser 220 completely, the stopper 218 is placed in the recess 223 to cause a 'click' sound. Accordingly, if the user pushes in the detergent box 210 until 'click' sounds, the detergent box 210 is placed in the dispenser 220 fully.

In the meantime, the elastic slot 219 at one side of the rib 216 having the stopper 218 formed thereon enables to prevent the stopper 218 from wearing down during the stopper 218 is placed in the recess 223. In other words, the stopper 218 is bent upward slightly in a process the stopper 218 moves along the side of the dispenser body 221 until the stopper 218 reaches to the recess 223 when the stopper 218 returns to an original state of a horizontal position. According to this, the wear down of a tip of the stopper 218 can be prevented.

Figure 5:
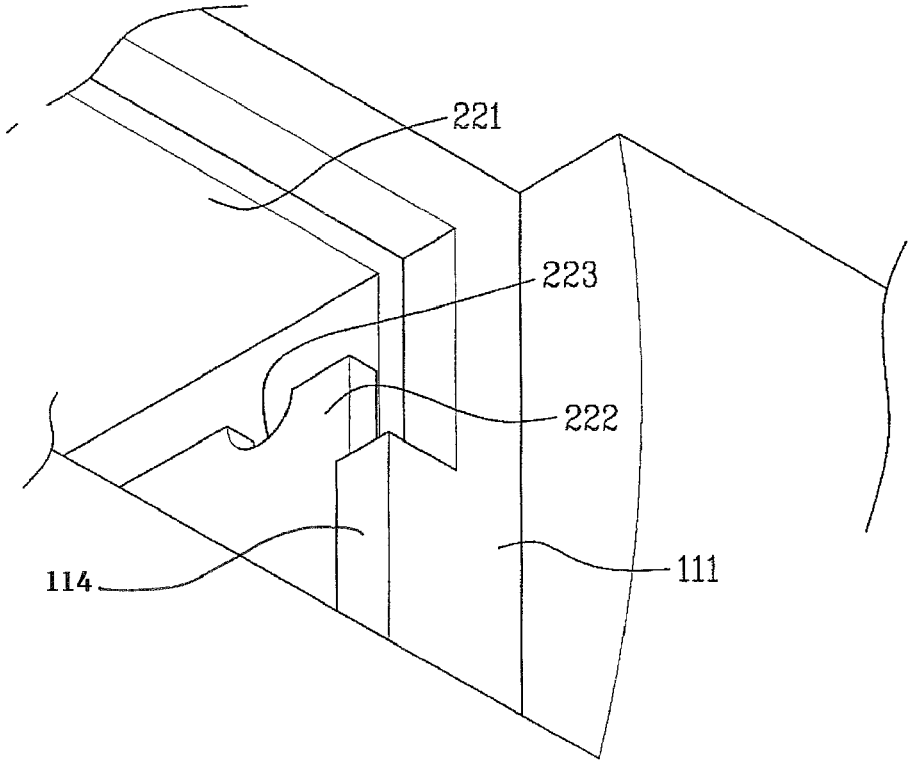
FIG. 5 illustrates an enlarged perspective view of an opening for placing a detergent box therethrough in accordance with a preferred embodiment of the present invention.

FIG. 5 illustrates an enlarged perspective view of an opening for placing a detergent box therethrough in accordance with a preferred embodiment of the present invention.

Referring to FIG. 5, on one side of the control panel 150, there is an opening 114 for placing the detergent box 210 therein. The opening 114 is connected to the dispenser 220 in the cabinet 110. The recess 223 is in the top of the side of the dispenser body 222 of the dispenser 220 for placing the stopper 218 therein.

In detail, the rib 216 of the detergent box 210 is inserted between the dispenser cover 221 and the top of the side of the dispenser body 222. In more detail, when the detergent box 210 is inserted through the opening 114, the rib 116 slides in through the top of the side of the dispenser body 222. Then, if the detergent box 210 is pushed in until 'click' sounds as the stopper 218 seats in the recess 223, the detergent box 210 is inserted, fully. Then, the cover front 211 is brought into close contact to a cover front contact surface 115 around the opening 114.

Thus, as the detergent box 210 is placed in the dispenser 220 fully, even if the washing machine is tilted in the middle of washing, the move out of the detergent box 210 is prevented. Moreover, the determination of the full placement of the detergent box 210 in the washing machine can be made with easy.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type washing machine comprising: a cabinet;

a tub positioned in the cabinet, wherein the tub receives washing fluid for washing laundry therein;

a dispenser provided on one side of the cabinet, the dispenser including a first lateral side surface and a second lateral side surface facing the first lateral side surface, and a third surface that extends between the first and second lateral side surfaces, the second lateral side surface having a recess formed in an upper edge thereof; and a detergent box that is slidably coupled to the dispenser, wherein the detergent box holds washing agents therein to be supplied to the tub, the detergent box including a first rib and a second rib that slide along the first surface and the second surface, respectively, of the dispenser, wherein the second rib includes:

a stopper that projects from a lower surface of the second rib, wherein the stopper slides along and is pressed against the second surface as the detergent box slides relative to the dispenser, and is released into the recess formed in the second surface of the dispenser so as to restrict movement of the detergent box relative to the dispenser; and an elastic slot that provides an elastic force to the stopper.

2. The drum type washing machine as claimed in claim 1, wherein the third surface extends between corresponding top ends of the first and second lateral side surfaces so as to define a top of the dispenser.

3. The drum type washing machine as claimed in claim 1, wherein at least one of the first rib or the second rib includes a push down projection that slides along a corresponding portion of the third surface as the detergent box slides relative to the dispenser.

4. The drum type washing machine as claimed in claim 3, wherein the push down projection projects upward from the at least one of the first rib or the second rib.

5. The drum type washing machine as claimed in claim 1, wherein the dispenser includes a dispenser cover defined by the third surface; and a dispenser body coupled to an underside of the dispenser cover, wherein the dispenser body is defined by the first and second lateral side surfaces and a fourth surface that extends between lower ends of the first and second lateral side surfaces.

* * * * *